US010660380B1

(12) United States Patent
Wendling

(10) Patent No.: US 10,660,380 B1
(45) Date of Patent: May 26, 2020

(54) EXTENDABLE LENGTH CHILDREN'S PANTS

(71) Applicant: Angela Wendling, Neenah, WI (US)

(72) Inventor: Angela Wendling, Neenah, WI (US)

(73) Assignee: Angela Wendling, Neenah, WI (US)

( * ) Notice: Subject to any disclaimer, the term of this patent is extended or adjusted under 35 U.S.C. 154(b) by 0 days.

(21) Appl. No.: 16/213,514

(22) Filed: Dec. 7, 2018

Related U.S. Application Data

(60) Provisional application No. 62/596,412, filed on Dec. 8, 2017.

(51) Int. Cl.
*A41D 1/06* (2006.01)
*A41B 7/02* (2006.01)
*A41D 11/00* (2006.01)

(52) U.S. Cl.
CPC ..... *A41D 1/06* (2013.01); *A41B 7/02* (2013.01); *A41D 11/00* (2013.01)

(58) Field of Classification Search
CPC ..... A41D 15/002; A41D 1/06; A41B 7/02
USPC ..... 2/269, 125, 227
See application file for complete search history.

(56) References Cited

U.S. PATENT DOCUMENTS 2,740,128 A 4/1956 Simon et al.
3,328,809 A 7/1967 Payne et al.
4,149,275 A * 4/1979 Sanchez ..... A41D 1/06 2/269
4,200,938 A 5/1980 LeTourneau
4,896,379 A 1/1990 Kape
4,985,936 A 1/1991 Jones
5,088,128 A 2/1992 Kape
5,535,453 A * 7/1996 Howard ..... A41D 1/06 2/227
5,669,077 A * 9/1997 Stewart ..... A41D 1/06 2/227
2008/0120759 A1 5/2008 Tolton
2009/0205112 A1* 8/2009 Solowey ..... A41D 15/002 2/269
2009/0205550 A1* 8/2009 George ..... A41D 15/002 112/475.24
2009/0235434 A1* 9/2009 Ratcliffe ..... A41D 15/002 2/269
2010/0299802 A1* 12/2010 Bailey ..... A41B 13/005 2/70

OTHER PUBLICATIONS

Website image believed to be available on or before Aug. 15, 2017; https://www.pinterest.com/pin/308496643216544423/.
Website image believed to be available on or before Aug. 15, 2017; https://www.pinterest.com/pin/453104412484780511/.
Website image believed to be available on or before Aug. 15, 2017; https://www.pinterest.com/pin/192036371589771231/.
(Continued)

*Primary Examiner* — Gloria M Hale
(74) *Attorney, Agent, or Firm* — Boyle Fredrickson, S.C.

(57) ABSTRACT

A pair of children's pants is provided that is configured to provide multiple pants sizes, by allowing selective release of leg material in stages. The pants may have a length extension system with cuff holders that can be sequentially released to provide longer legs, in stages. The cuff holders may be configured to permanently release the legs to the longer length states during the releasing/lengthening stages.

8 Claims, 7 Drawing Sheets

(56) References Cited

OTHER PUBLICATIONS

Website image believed to be available on or before Aug. 15, 2017; https://www.pinterest.com/pin/341429215481236301/.
Website image believed to be available on or before Aug. 15, 2017; https://www.pinterest.com/pin/327707310362020174/; and https://www.petit-cochon.de/shop/alle-lieblingssachen/1062/knickerbocker-fischgrat?c=20.
Website image believed to be available on or before Aug. 15, 2017; https://www.pinterest.com/pin/171770173260086735/.
Website image believed to be available on or before Aug. 15, 2017; https://www.pinterest.com/pin/27936460161057258/; and https://www.etsy.com/listing/121678703/baby-boy-herringbone-pants-with-large.
Website image believed to be available on or before Aug. 15, 2017; https://www.liltulips.com/Max-and-Meena-Maxaloones-Moose_p_2658.html.
Archived website image believed to be available on or before Aug. 13, 2017; https://web.archive.org/web/20171116080209/http://www.titchythreads.com/patterns/fancy_pants_leggings.
Archived website image believed to be available on or before Oct. 2, 2016; https://web.archive.org/web/20161002134555/https://www.amazon.com/ExOfficio-Womens-Nomad-Roll-Up-Pant/dp/B0043EVSBO.

* cited by examiner

EXTENDABLE LENGTH CHILDREN'S PANTS

CROSS-REFERENCE TO RELATED APPLICATION

This application claims priority from U.S. Provisional Patent Application Ser. No. 62/596,412, filed on Dec. 8, 2017, the entirety of which is expressly incorporated by reference herein.

FIELD OF THE INVENTION

The present invention relates generally to children's clothing and, more specifically, to a pair of children's pants with extendable length.

BACKGROUND OF THE INVENTION

Children grow so rapidly that keeping them in appropriately sized clothing can be challenging. Many children grow out of their clothing well before the clothing is worn-out, stained, or otherwise unusable. Young children such as those in diapers can outgrow the length of pants event though the pants may have enough width to still be worn. Attempts to roll-up pant legs can be frustrating since they tend to unroll, which makes the ends of the pant legs susceptible to quick wear by being stepped on or dragged loosely. Rolled pant legs that are buttoned or tied up are typically rolled in a single direction and the rolled material tends to droop down and compress into a ring-shaped mass at the bottom of the pant leg(s), which can be unsightly.

SUMMARY OF THE INVENTION

A pair of children's pants is provided that is configured to provide multiple pants sizes by allowing selective release of leg material in stages. The pants may have a length extension system with cuff holders that can be sequentially released to provide longer legs, in stages. The cuff holders may be configured to permanently release the legs to the longer length states during the releasing/lengthening stages.

According to an aspect of the invention, a pair of extendable length children's pants is provided. The pants include a pants body with an upper portion that has a waist segment that defines a waist opening. A lower pants portion with a pair of legs extends downwardly from the upper portion to lower ends of the legs that define leg openings. A length extension system selectively holds the leg in multiple leg length states for changing leg lengths. At each lower leg end, the length extension system includes an extendable cuff and multiple cuff holders. The cuff holders may be spaced from each other to retain the extendable cuff in one of the multiple cuff length states that correspond to the multiple leg length states. The cuff length states may be defined by cuff folded states.

According to another aspect of invention, a first pair of cuff holders are arranged at opposite sides of the leg, for example, at outside and inside seams of the leg. Each of the cuff holders of the first pair of cuff holders may be spaced from the leg opening. The leg may define inner and outer surfaces and the cuff holders of the may extend between and attach an upper folded edge of the extendable cuff to the leg outer surface.

According to another aspect of the invention, the cuff holders may define a web of material, such as a strap, that defines upper and lower ends. The upper end of each cuff holder may be sewn to the outer surface of the leg. The lower end of each cuff holder may be sewn to the upper folded edge of the extendable cuff, which may define a first folded state of the extendable cuffs.

According to another aspect of invention, the first pair of cuff holders may define a pair of upper cuff holders and the length extension system may further include a second pair of cuff holders that are spaced from the pair of upper cuff holders, for example, below the pair of upper cuff holders to define a pair of lower cuff holders. The second or lower pair of cuff holders may be arranged at outside and inside seams of the leg and each of the pair of lower cuff holders may be adjacent the leg opening.

According to another aspect of the invention, the extendable cuff(s) of the leg(s) may include an upper folded cuff edge, a lower folded cuff edge, and an unfolded lower cuff edge. The pair of upper cuff holders may secure the upper folded cuff edge to the leg and the pair of lower cuff holders may secure the lower folded cuff edge to the unfolded lower cuff edge. When the upper and lower pairs of cuff holders secure the extendable cuff in a first folded state, the extendable cuff defines an accordion style fold that present the lower folded cuff edge concentrically inward of the lower unfolded cuff edge.

Figure 1:
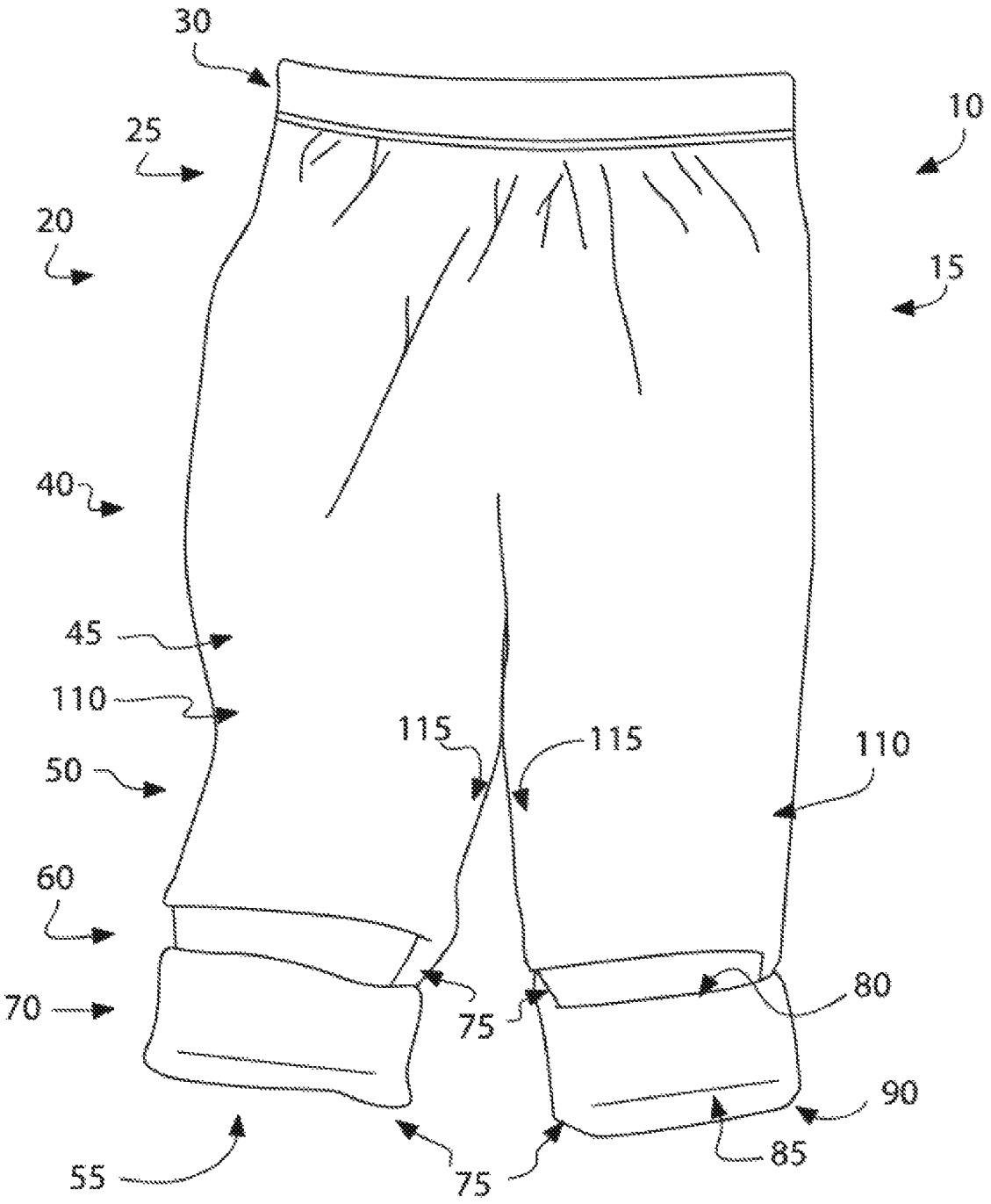
FIG. 1-7 show various views of a pair of extendable length children's pants, according to the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a pair of extendable length children's pants, shown here as pants 10, is provided that is configured for extending its length to convert into multiple pants sizes, in stages. Pants 10 include pants body 15 with an upper portion 20 that has a waist segment 25 with waistband 30 that defines a waist opening. Lower pants portion 40 includes a pair of legs 45 that extends downwardly from the upper portion 20 to lower ends 50 of the legs 45 that define leg openings 55.

Still referring to FIG. 1, a length extension system 60 selectively holds each leg 45 in multiple leg length states for changing their leg lengths. At each leg 45, length extension system 60 includes an extendable cuff, shown here as cuff 70 and multiple cuff holders 75. Cuff holders 75 are configured to hold the cuff 70 in various different positions or states that correspond to the different stages of leg length release and thus also pants sizes, explained in greater detail elsewhere herein. Cuff 70 is shown as an elongate tube of materials that extends from the bottom of leg 45 and is folded multiple times to provide a fully collapsed state. In its fully collapsed state such as that shown in FIG. 1, cuff 70 provides its shortest cuff length state and shortest leg length state to leg 45. The collapsed state of cuff 70 may be defined by an accordion-style fold that provides a z-shaped or zig-zag overlap of folded segments, which give the cuff 70 multiple folds and multiple fold edges that include a first fold or first folded cuff edge shown as upper folded cuff edge 80, a second fold or second folded cuff edge shown as lower folded cuff edge 85, and an unfolded cuff edge shown as unfolded lower cuff edge 90.

Figure 2:
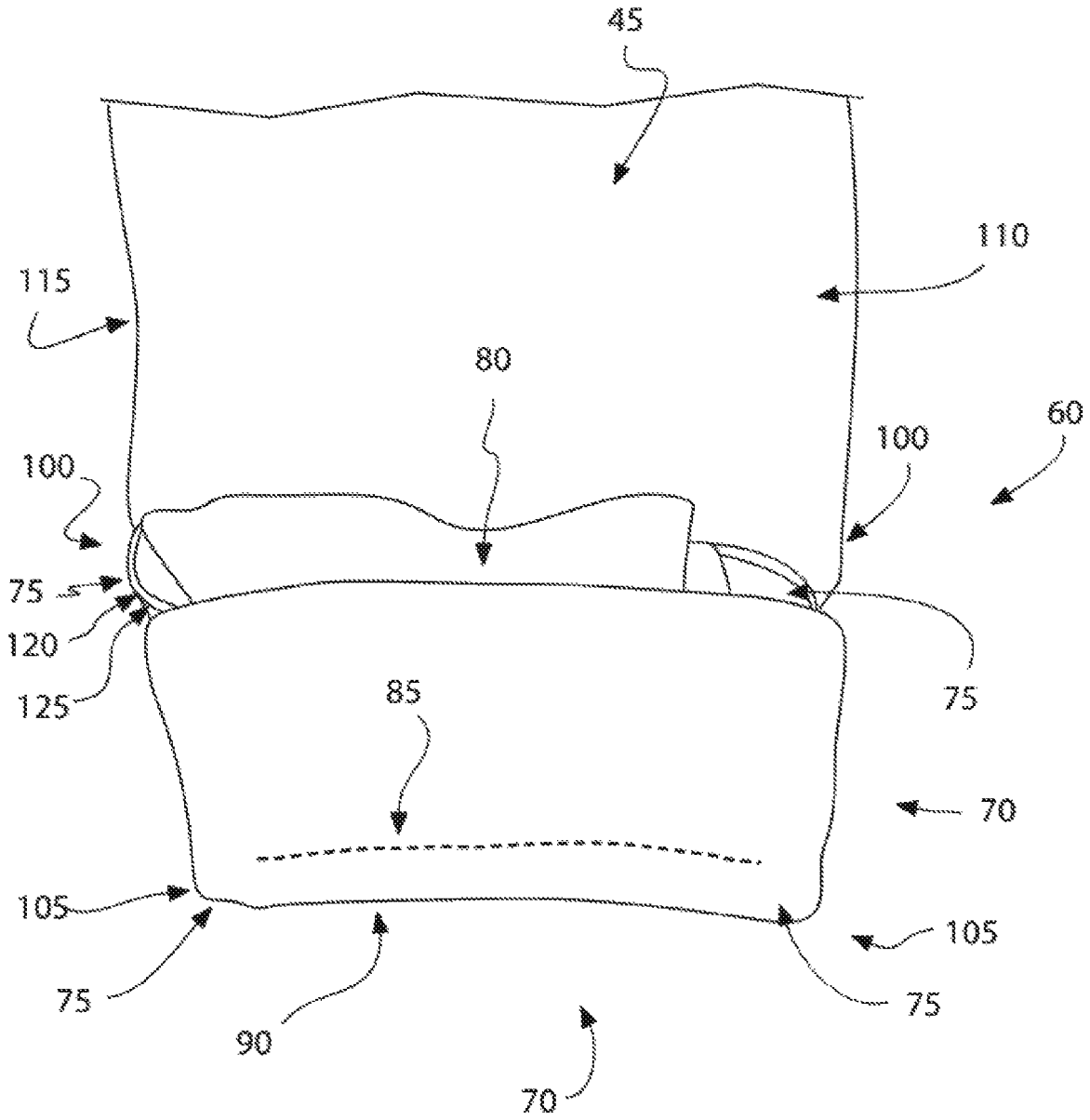
Figure 3:
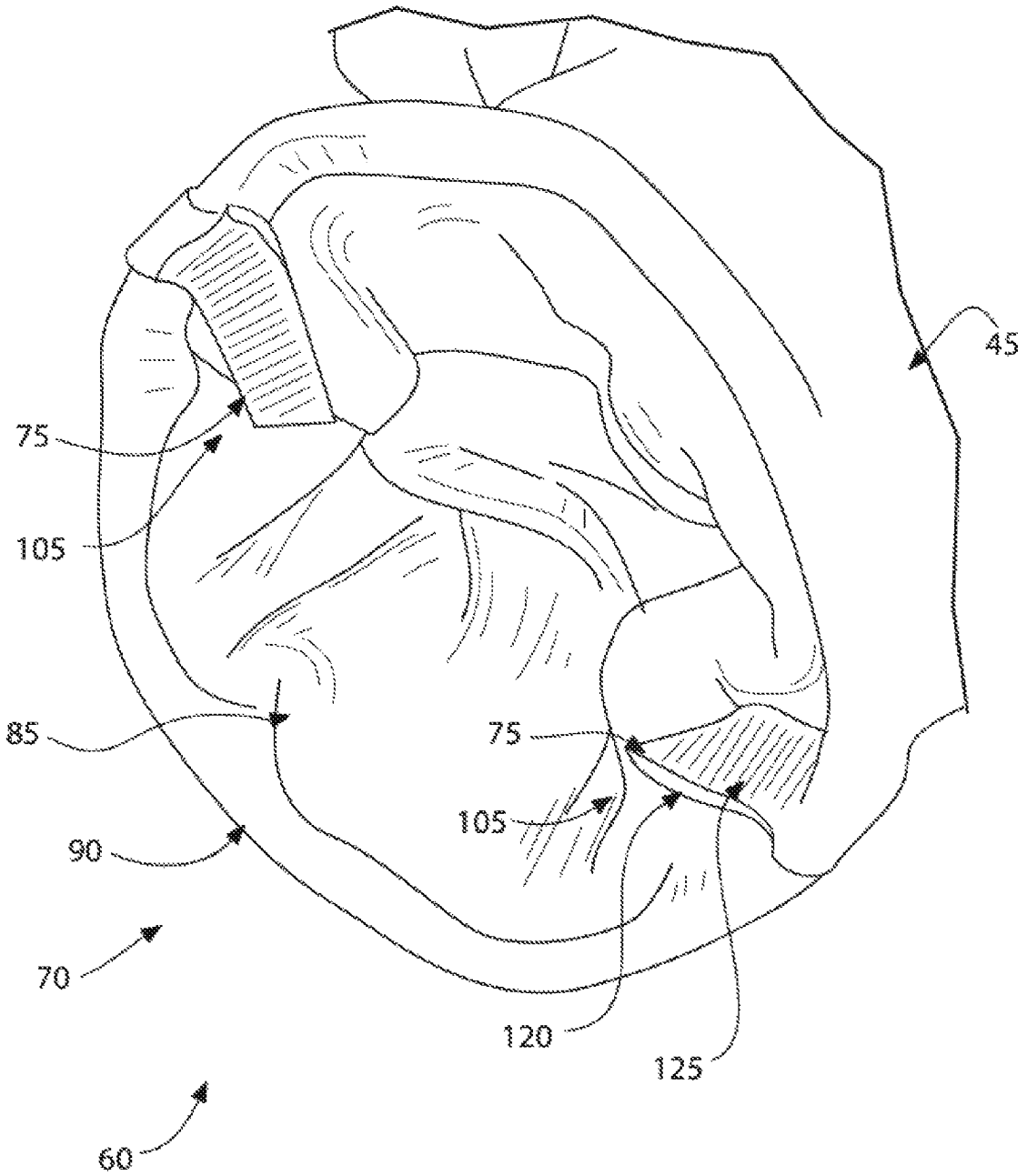

Referring now to FIGS. 2 and 3, cuff holders 75 may be provided as pairs of cuff holders 75. FIG. 2 shows a first pair of holder as a pair of upper cuff holders 100 and FIG. 3 shows a second pair of holders as a pair of lower cuff holders 105. Upper cuff holders 100 (FIG. 2) are configured to secure an upper portion of cuff 70 in its folded state and lower cuff holders 105 (FIG. 3) are configured to secure a lower portion of cuff 70 in its folded state. Cuff holders 75 of the upper and lower cuff folds 100, 105 are shown arranged at the inside and outside of pants legs 45, for example, at outside and inside seams 110, 115 so that each of the pair of upper and lower cuff holders 100, 105 includes an outside cuff holder 75 and an inside cuff holder 75. Each of the upper and lower cuff holders 100, 105 may be made from a web of material 120 that may define a strap 125. The material 120 of strap 125 may be different from that of other portions of pants 10. Strap 125 may be less flexible that the pants 10, so that straps 125 stretch less than the portions of pants 10 than they secure.

Figure 4:
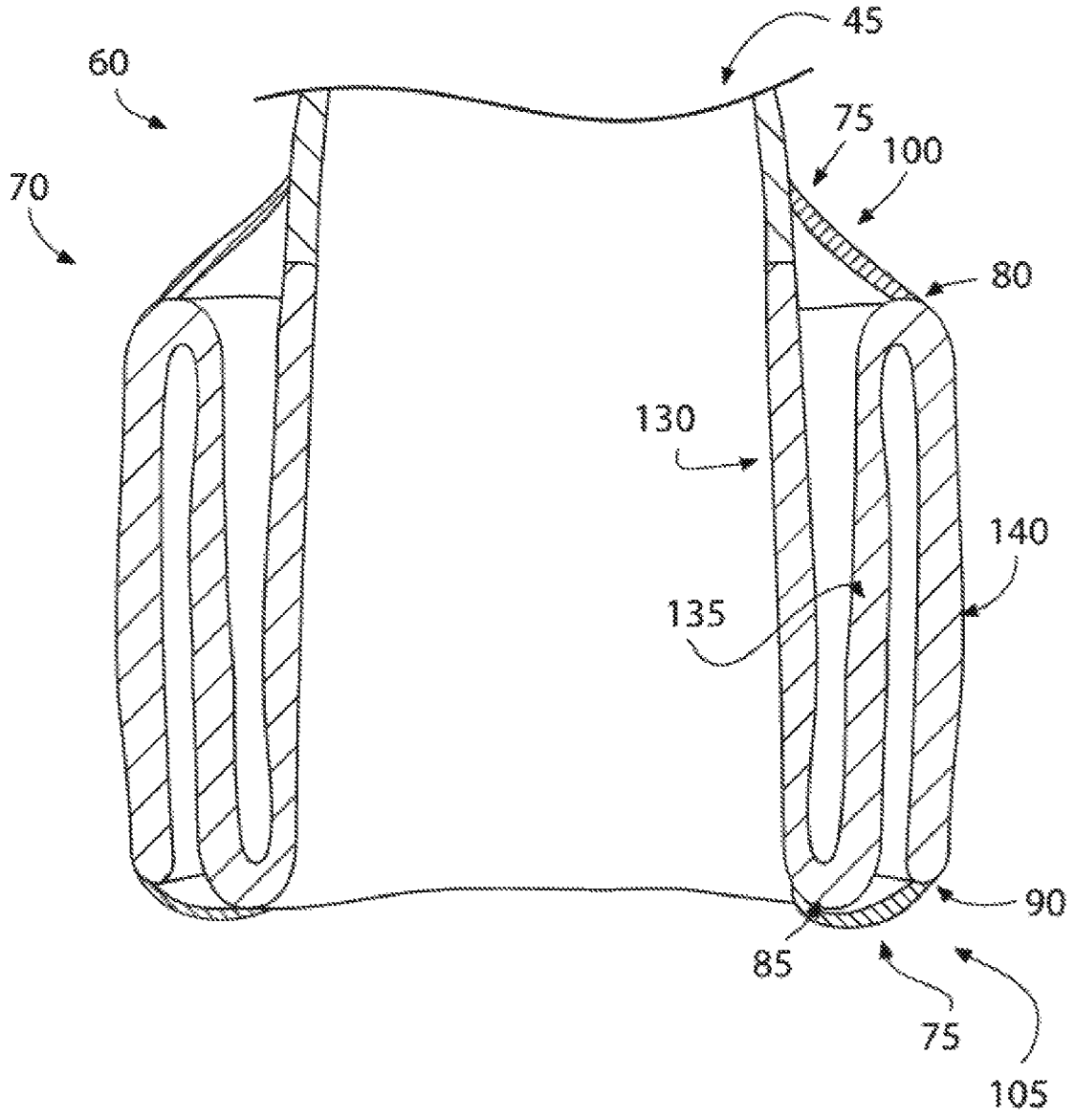
Figure 5:
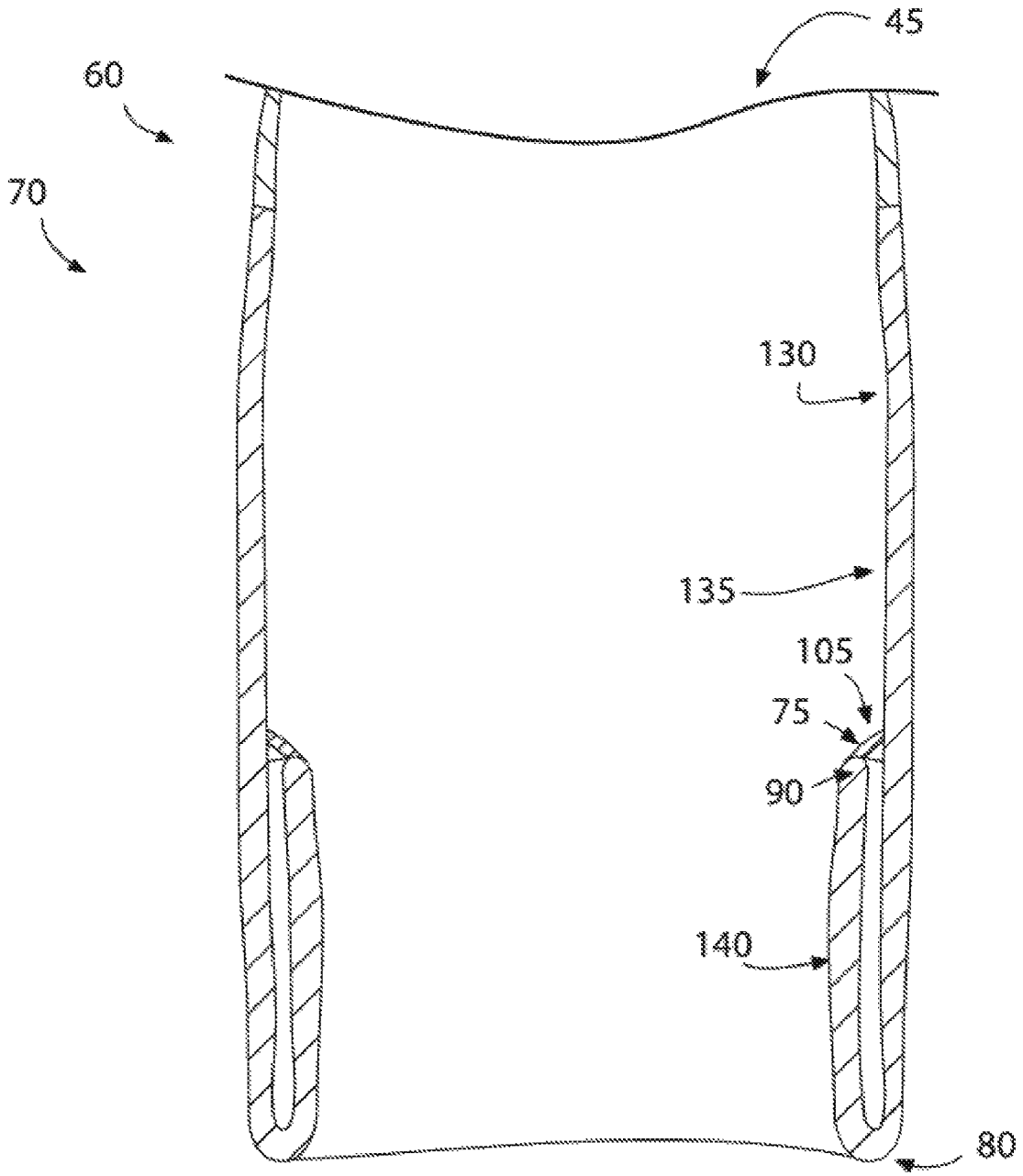
Figure 6:
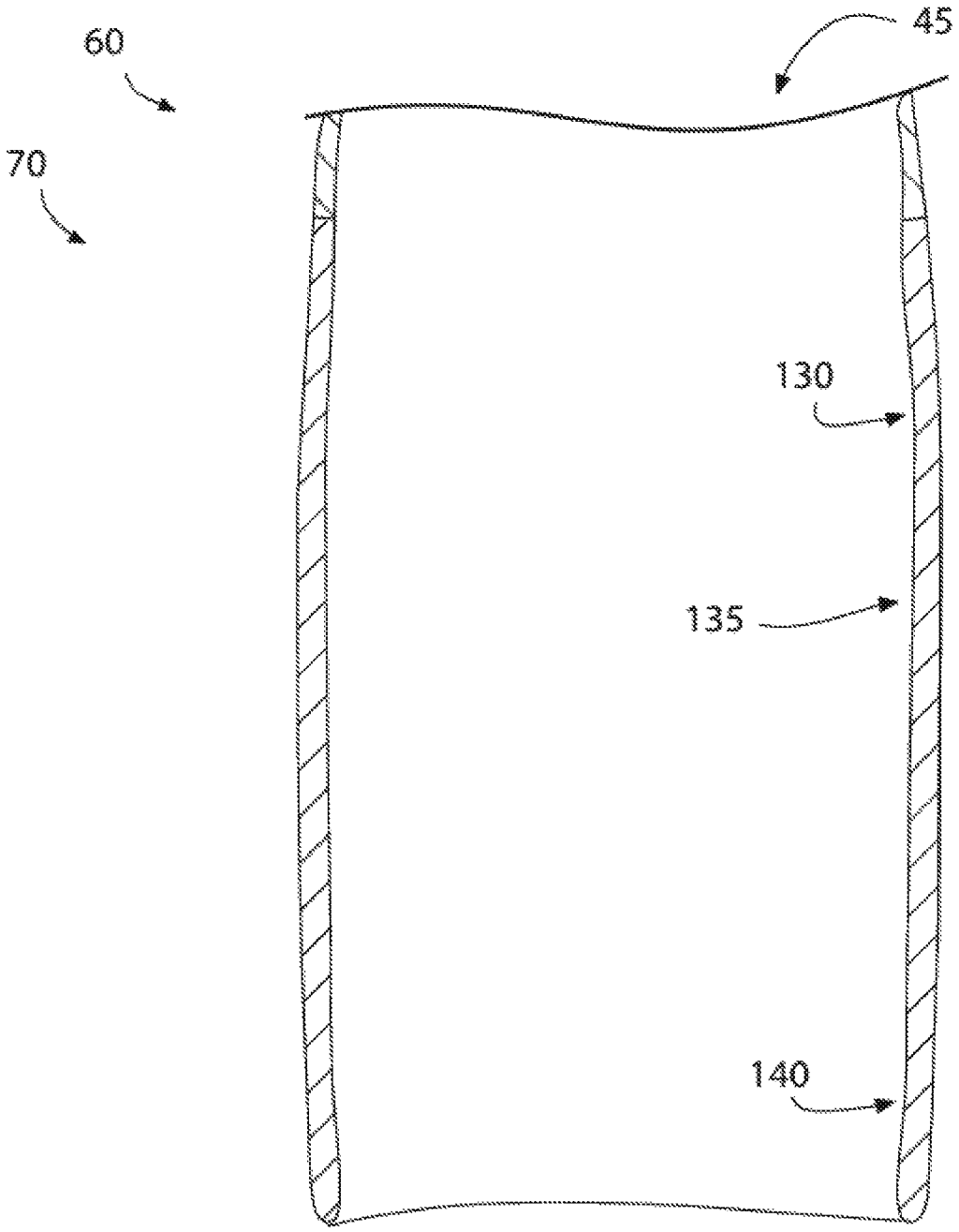

Referring now to FIGS. 4-6, various folded states of cuff 70 are shown in cross-sectional representation. As shown in FIG. 4, when in the fully folded shortest length state of cuff 70 and leg 45, cuff 70 have multiple layers of back and forth folded cuff segments to provide the accordion style fold. The segments include an upper cuff segment 130 that connects to the bottom of pants leg 45. In the fully folded state of cuff 70, upper cuff segment is the concentrically inner most layer of the cuff 70. Intermediate cuff segment 135 has a lower portion that connects to a lower portion of upper cuff segment 130, which defines the second fold or lower folded cuff edge 85. From the second fold or lower folded cuff edge 85, intermediate cuff segment 115 extends upwardly to an upper portion of intermediate cuff segment 115, near a point of intersection of upper cuff segment 130 and a lower portion of pants leg 45. An upper portion of outer cuff segment 140 is connected to the upper portion of intermediate cuff segment 135 at the first fold or upper folded cuff edge 80. Outer cuff segment 140 extends from its upper portion downwardly to its lower portion, ending at the unfolded edge or unfolded lower cuff edge 90.

Referring now to FIG. 5, a first released or intermediate lengthened state of cuff 70 and leg 45 is shown. The pair of upper cuff holders 100 has been released such as by cutting and removal to provide the first released state in which only a single fold remains and the multiple layers of cuff 70 are defined by two material layers. The second or formerly lower folded cuff edge 105 shown in FIG. 4 has been unfolded and is not present in FIG. 5. The first fold that was formerly the upper folded cuff edge 100 in FIG. 4 now defines a lower folded edge and the unfolded edge that was an unfolded lower cuff edge 90 now defines an upper unfolded cuff edge.

Referring now to FIG. 6, a second released or fully lengthened state of cuff 70 and leg 45 is shown. In addition to the released first pair of holders as upper cuff holders 80, the second pair of holders or pair of lower cuff holders 85 has been released such as by cutting and removal to provide the second released or fully extended state in which there is no fold in cuff 70. The lowered unfolded lower cuff edge 90 again defines a lower cuff edge, this time as the only lower cuff edge with the cuff 70 extending continuously and along an unfolded path to the leg 45.

Figure 7:
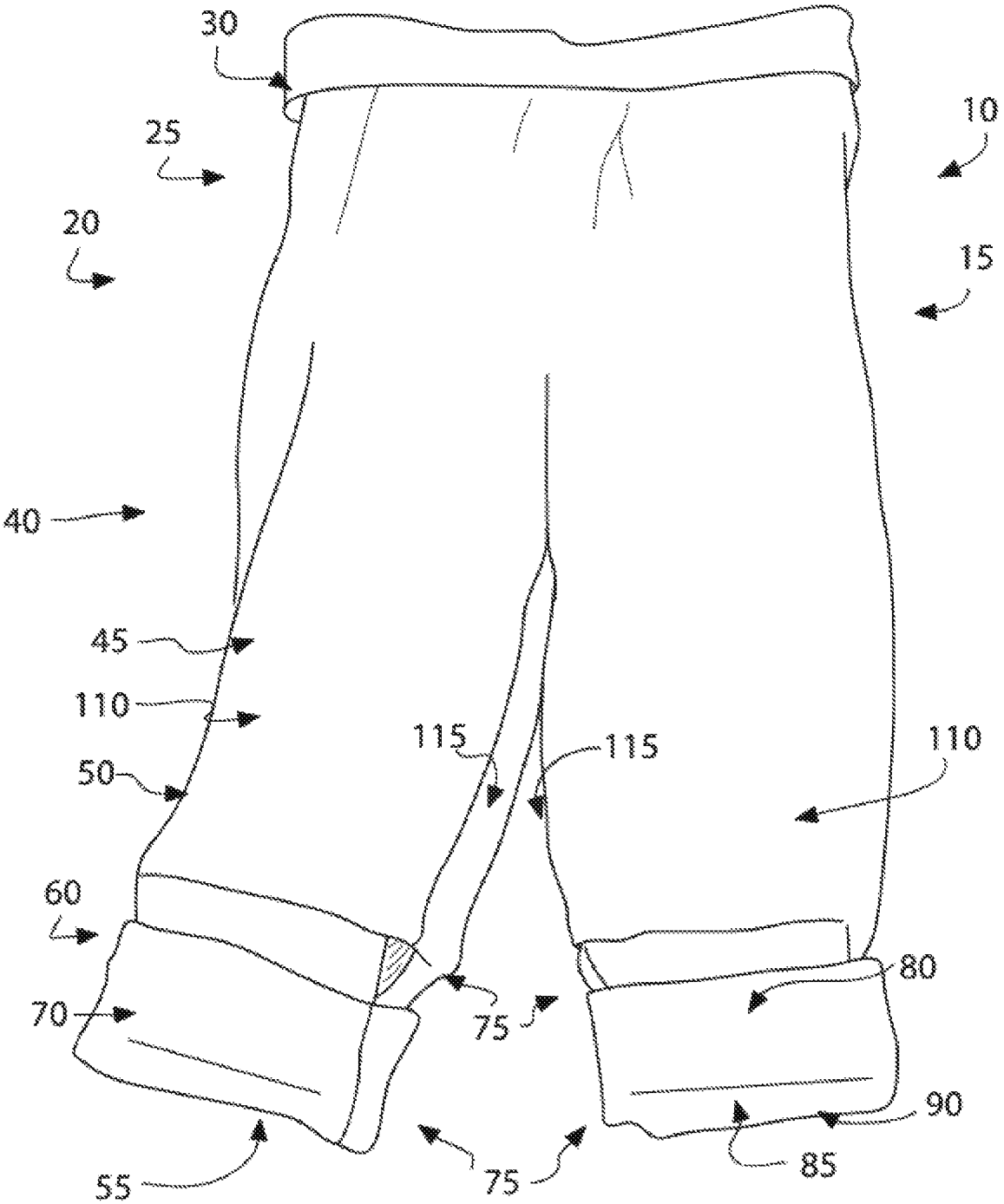

Referring now to FIG. 7, length extension system 60 may also include a mechanism(s) to extend the length of pants 10 from the upper portion 20 of pants body 15. One example, is that waistband 30 may be configured to provide additional length adjustment of pants 10 by rolling down to shorten the overall pants length or unrolling to lengthen the overall length of pants 10. Text or other indicia many be printed, stitched, or otherwise provided upside down in waistband 30 so that when rolled down in the shorter state, such text or other indicia is presented normally or right side up.

Many changes and modifications could be made to the invention without departing from the spirit thereof. The scope of these changes will become apparent from the appended claims.

What is claimed is:

1. A pair of extendable length children's pants, comprising:

a pants body that includes:

an upper portion with a waist segment that defines a waist opening;

a lower pants portion with a pair of legs that extend downwardly from the upper portion to lower ends of the legs that define leg openings;

a length extension system for selectively holding each leg of the pair of legs in a selected one of multiple leg length states to therefore change the pant leg length as desired, wherein at each lower end of each leg, the length extension system includes:

an extendable cuff defined at the lower end of each leg; and multiple cuff holders including at least one pair of cuff holders at each leg of the pair of legs to for selectively holding the respective leg at a corresponding one of the multiple leg length states;

wherein:

the multiple leg length states are defined by multiple cuff folded states;

at each extendable cuff of each leg, the at least one pair of cuff holders includes a first pair of cuff holders arranged at opposite sides of the respective leg;

the cuff holders of the first pair of cuff holders are arranged at outside and inside seams of the leg;

each of the cuff holders of the first pair of cuff holders are spaced from the leg opening; and the leg defines an inner surface and an outer surface and wherein cuff holders of the first pair of cuff holders attach an upper folded edge of the extendable cuff to the outer surface of the leg.

2. The pair of extendable length children's pants of claim 1, wherein each of the cuff holders defines a web of material that extends between first and second ends to define upper and lower ends of the cuff holder and wherein the upper end of the cuff holder is sewn to the outer surface of the leg and the lower end of the cuff holder is sewn to upper folded edge of the extendable cuff to define a first folded state of the extendable cuffs.

3. A pair of extendable length children's pants, comprising:

a pants body that includes:

an upper portion with a waist segment that defines a waist opening;

a lower pants portion with a pair of legs that extend downwardly from the upper portion to lower ends of the legs that define leg openings;

a length extension system for selectively holding each leg of the pair of legs in a selected one of multiple leg length states to therefore change the pant leg length as desired, wherein at each lower end of each leg, the length extension system includes:

an extendable cuff defined at the lower end of each leg; and multiple cuff holders including at least one pair of cuff holders at each leg of the pair of legs to for selectively holding the respective leg at a corresponding one of the multiple leg length states;

wherein:

the multiple leg length states are defined by multiple cuff folded states;

at each extendable cuff of each leg, the at least one pair of cuff holders includes a first pair of cuff holders arranged at opposite sides of the respective leg; and the first pair of cuff holders defines a pair of upper cuff holders and the length extension system further comprises a second pair of cuff holders that are spaced from the pair of upper cuff holders.

4. The pair of extendable length children's pants of claim 3, wherein the second pair of cuff holders defines a pair of lower cuff holders and arranged at opposite sides of the leg.

5. The pair of extendable length children's pants of claim 4, wherein the cuff holders of the second pair of cuff holders are arranged at outside and inside seams of the leg.

6. The pair of extendable length children's pants of claim 5, wherein each of the cuff holders of the second pair of cuff holders are adjacent the leg opening.

7. The pair of extendable length children's pants of claim 6, wherein the extendable cuff defines an upper folded cuff edge, a lower folded cuff edge, and an unfolded lower cuff edge and where the pair of upper cuff holders secures the upper folded cuff edge to the leg and the pair of lower cuff holders secures the lower folded cuff edge to the unfolded lower cuff edge.

8. The pair of extendable length children's pants of claim 7, wherein when the upper and lower pairs of cuff holders secure the extendable cuff in a first folded state, the extendable cuff defines an accordion style fold that present the lower folded cuff edge concentrically inward of the lower unfolded cuff edge.

* * * * *